US006488513B1

(12) United States Patent
Neidich et al.

(10) Patent No.: US 6,488,513 B1
(45) Date of Patent: Dec. 3, 2002

(54) INTERPOSER ASSEMBLY FOR SOLDERED ELECTRICAL CONNECTIONS

(75) Inventors: Douglas A. Neidich, Harrisburg, PA (US); Donald W. Milbrand, Jr., Duncannon, PA (US)

(73) Assignee: InterCon Systems, Inc., Harrisburg, PA (US)

( * ) Notice: Subject to any disclaimer, the term of this patent is extended or adjusted under 35 U.S.C. 154(b) by 0 days.

(21) Appl. No.: 10/021,823

(22) Filed: Dec. 13, 2001

(51) Int. Cl.[7] ..... H01R 12/22
(52) U.S. Cl. ..... 439/66
(58) Field of Search ..... 439/66, 91, 591, 439/65

(56) References Cited

U.S. PATENT DOCUMENTS

| | | | | |
|---|---|---|---|---|
| 3,551,750 | A | 12/1970 | Sterling | |
| 3,960,424 | A | 6/1976 | Weisenburger | |
| 4,505,529 | A | 3/1985 | Barkus | |
| 4,655,519 | A | 4/1987 | Evans et al. | |
| 4,998,886 | A | 3/1991 | Werner | 439/66 |
| 5,137,456 | A | 8/1992 | Desai et al. | 439/66 |
| 5,324,205 | A | 6/1994 | Ahmad et al. | 439/66 |
| 5,358,411 | A | 10/1994 | Mroczkowski et al. | 439/66 |
| 5,395,252 | A | 3/1995 | White | 439/66 |
| 5,466,161 | A | 11/1995 | Yumibe et al. | 439/66 |
| 5,498,166 | A | 3/1996 | Rothenberger | 439/66 |
| 5,511,984 | A | 4/1996 | Olson et al. | 439/79 |
| 5,677,247 | A | 10/1997 | Hundt et al. | 437/209 |
| 5,805,419 | A | 9/1998 | Hundt et al. | 361/719 |
| 5,921,787 | A | 7/1999 | Pope et al. | 439/74 |
| 5,951,303 | A | 9/1999 | Wilmsmann nee Sudmoller | 439/66 |
| 5,967,797 | A | 10/1999 | Maldonado | 439/66 |
| 5,967,800 | A | 10/1999 | Bishop | 439/74 |
| 5,975,914 | A | 11/1999 | Uchida | 439/66 |
| 5,980,268 | A | 11/1999 | Mischenko et al. | 439/66 |
| 6,000,969 | A | 12/1999 | Reichardt et al. | 439/630 |
| 6,016,254 | A | 1/2000 | Pfaff | 361/769 |
| 6,077,089 | A | 6/2000 | Bishop et al. | 439/66 |
| 6,079,988 | A | 6/2000 | Hashiguchi et al. | 439/66 |
| 6,083,013 | A | 7/2000 | Yamagishi | 439/71 |
| 6,116,921 | A | 9/2000 | Scholz et al. | 439/83 |
| 6,132,220 | A | 10/2000 | McHugh et al. | 439/66 |
| 6,132,222 | A | 10/2000 | Wang et al. | 439/70 |
| 6,142,790 | A | 11/2000 | Niitsu | 439/66 |
| 6,146,152 | A | 11/2000 | McHugh et al. | 439/66 |
| 6,155,860 | A | 12/2000 | Lemke et al. | 439/341 |
| 6,345,987 | B1 * | 2/2002 | Mori et al. | 439/66 |

* cited by examiner

*Primary Examiner*—Gary Paumen
(74) *Attorney, Agent, or Firm*—Thomas Hooker, P.C.

(57) ABSTRACT

An interposer assembly includes an insulating plate with passages extending through the thickness of the plate and metal contacts in the passages. The contacts have resilient upper and lower contact arms that deflect into upper and lower recesses of the plate when sandwiched between contact pads of overlying and underlying circuit members. The recesses are sized to accommodate solder connections between contact arms and contact pads.

29 Claims, 4 Drawing Sheets

INTERPOSER ASSEMBLY FOR SOLDERED ELECTRICAL CONNECTIONS

FIELD OF THE INVENTION

The invention relates to interposer assemblies used for forming electrical connections between spaced contact pads on circuit members.

BACKGROUND OF THE INVENTION

Interposer assemblies are used for forming electrical connections between densely spaced contact pads on adjacent parallel circuit members. Commonly, the circuit members are a circuit board and a ceramic plate carrying integrated circuits. The pads on the members are arranged in identical patterns.

The interposer assembly includes an insulating plate and a plurality of through-contacts carried in the plate and arranged in the same pattern as the pads on the circuit members. The assembly is sandwiched between upper and lower circuit members to form electrical connections between opposed pairs of contact pads.

In one type of interposer assembly, the lower circuit member is permanently held against the bottom side of the plate before the upper circuit member is pressed against the plate. The contact pads on the lower circuit member are soldered to the contacts. This enables the interposer assembly and lower circuit member to form a subassembly that is assembled later with the upper circuit member to interconnect the circuit members.

The contact pads on the lower circuit member each include a solder layer to form the soldered connections. The lower circuit member is pressed against the bottom side of the plate with the solder layer on the pads engaging the contacts. The lower circuit member and interposer plate are placed in a reflow oven to melt the solder layer and solder the contacts and contact pads together. The solder connections form reliable mechanical and electrical connections between the contacts and contact pads and hold the lower circuit member firmly against the plate.

The contacts project above the top surface of the plate of the soldered subassembly. The upper circuit member is pressed against the upper side of the plate with the contact pads on the upper member engaging the contacts. The upper circuit member is held against the plate with the contacts forming electric connections between aligned pairs of pads.

Interposer assemblies form electrical connections between contact pads arranged in very close proximity to each other. The pads may be arranged on a one millimeter center-to-center grid. A number of interposer assemblies may be mounted on a single frame, with thousands of contacts in the frame. In addition to requiring closely spaced contacts, the contacts must make reliable electrical connections with the pads when the assemblies are sandwiched between the circuit members. Failure of a single contact to make a reliable connection renders the entire frame useless.

A low mechanical closure force is required in order to prevent undue stress on a ceramic circuit member. A high closure force could distort or possibly break the ceramic member. Further, interposer assemblies must occupy a minimum width between the circuit members. The contacts must compress and enable the circuit members to be flush against the plate. The contacts must be compliant or resilient enough to deform with a lower closing force and yet must be sufficiently stiff to establish reliable electrical connections between pairs of contact pads.

Conventional interposer assemblies in which one circuit member is soldered to contact pads have contacts that are relatively rigid after being soldered to the contact pads. A high closing force is required to press the other circuit member flush against the interposer plate.

On occasion it may be necessary to replace a circuit member with a substitute circuit member if a defect were found after pressing the circuit member against the interposer plate. The is compressed contacts do not have sufficient resiliency to return to their original projections above the plate after removal of the circuit member. Reengagement of the contacts with the contact pads of the substitute circuit member often results in failure of one or more contacts to form electrical connections.

SUMMARY OF THE INVENTION

The invention is an improved interposer assembly including metal through contacts confined in closely spaced passages extending through an insulating plate. The contacts have resilient upper and lower contact arms that space contact surfaces away from opposite sides of the plate. The contact arms can be compressed against contact pads of circuit members with a low closing force. However, the contact arms are sufficiently resilient to return the contact surfaces away from the plate for reengagement with contact pads if necessary to permit adjustment or replacement of the circuit member.

The upper and lower contact arms of each contact are compressed by the contact pads independently of one another. This permits the contact pads of one circuit member to be soldered to the contact arms on one side of the plate prior to assembly of the interposer assembly with the other circuit member. The compression of the contact arms by the one circuit member does not affect the resiliency and shape of the contact arms on the other side of the plate. The contact arms on the opposite side of the plate remain in position to form reliable pressure connections or solder connections with the contact pads of the other circuit member.

An interposer assembly having features of the present invention includes an insulated plate and a number of metal contacts carried in the plate. The plate is formed from a single piece of insulating material. A number of single contact passages are in the plate, each contact passage including a slot extending through the thickness of the plate, an upper recess extending away from the slot and open to the top surface of the plate, and a lower recess extending away from the slot and open to the bottom surface of the plate. The slot includes a nominal width portion extending from the top surface of the plate and a reduced width portion extending from the bottom surface of the plate. A transverse wall joins the slot portions.

Each contact includes a body portion in a passage slot, with upper and lower contact arms extending from the body portion. A contact surface is on each contact arm, the distance between the contact surfaces greater than the thickness of the plate when the contact arms are unstressed. The contact body portion has a nominal width portion in the nominal width portion of the slot and a reduced width portion in the reduced width portion of the slot and includes an abutment surface abutting the transverse wall of the slot to locate the contact in the contact passage. The upper contact arm extends into the upper recess and overlies a recessed floor of the upper recess and the lower contact arm extends into the lower recess and overlies the floor of the lower recess of the passage.

When a circuit member is pressed against the lower contact arms, each contact arm engages the floor of the lower recess to maintain the position of the contact in the passage slot. This enables the sets of upper and lower contact arms to be deflected essentially independently of one another.

The compressed contact arms move entirely within the upper and lower recesses when the plate is compressed between circuit members. The lower set of recesses is sized to accommodate solder connections in the recesses to enable soldering of the lower contact arms to contact pads. Preferably the upper recesses are also sized to accommodate solder connections in the recesses. This permits identical plates to be used having contacts with upper contact arms configured to form pressure connections or upper contact arms configured to form solder connections to electrically connect with contact pads.

Other objects and features of the invention will become apparent as the description proceeds, especially when taken in conjunction with the accompanying drawings illustrating the invention, of which there are four sheets of drawings and two embodiments are disclosed.

DESCRIPTION OF THE PREFERRED EMBODIMENTS

Figure 1:
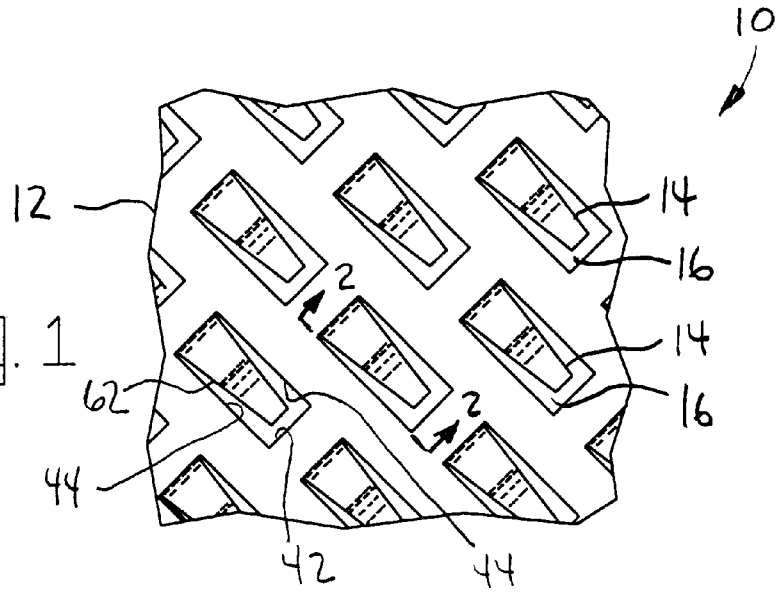
FIG. 1 is a top view of a first embodiment interposer assembly per the invention.

First embodiment interposer assembly 10 includes a single-piece plate 12 formed of insulating material. A plurality of metal through contacts 14 are positioned in single contact passages 16 extending through the thickness of the plate between opposed plate top and bottom plate surfaces 18 and 20. The top and bottom surfaces 18, 20 are flat and parallel to one another and are separated by the uniform thickness of the plate 12.

The contact passages 16 are spaced apart from one another in the plate 12. As shown in FIGS. 1 through 4, each passage 16 includes a slot 22 that extends through the thickness of the plate 12. An upper recess 24 extends from the slot 22 and is open to the top surface of the plate 12. A lower recess 26 also extends from the slot 22 and is open to the bottom surface of the plate 12. The recesses 24, 26 extend in a common direction away from the slot 22 and overlie one another to interconnect vertically aligned pairs of contact pads. In other possible embodiments the upper and lower recesses may extend in different directions from the slot with respect to each other to interconnect laterally offset pairs of contact pads.

The slots 22 are each symmetrical to either side of a central plane extending through the slot 22 and perpendicular to the top and bottom surfaces of the plate. The slot 22 is bounded by a pair of opposed end walls 28, 29 that define opposite ends of the slot. An upper pair of opposed sidewalls 30 extend inwardly from the top surface of the plate and join the end walls 28, 29. The upper sidewalls 30 bound an upper portion of the slot 22 and define a nominal width portion of the slot. A lower pair of opposed sidewalls 34 extend inwardly from the bottom surface of the plate and join the end walls 28. The lower sidewalls 34 bound a lower portion 36 of the slot 22 and define a reduced width portion of the slot. A transverse wall 38 between the upper and lower pairs of sidewalls extends from the upper sidewalls 30 and joins the lower sidewalls 34. The transverse wall 38 is parallel with and faces the top surface 18 of the plate 12. Wall 38 limits insertion of a contact 14 into passage 16.

The upper recess 22 of each passage 16 includes a floor 40 that faces the top surface 18 of the plate 12. The floor 40 is spaced inwardly from the top surface of the plate and extends away from the end wall 28 of the passage slot 22 opposite the transverse wall 38 to a recess end wall 42. The floor 40 slopes from the passage slot 22 towards the top surface of the plate. A pair of opposed sidewalls 44 extend from the top surface of the plate to the floor 40. The sidewalls 44 are parallel with one another and extend from the slot upper sidewalls 30, whereby the width of the upper recess 24 between the sidewalls 44 is equal to the nominal width of the slot 22.

The lower recess 24 of each passage 16 includes a floor 46 that faces the bottom surface 20 of the plate 12. The floor 46 is spaced inwardly from the top surface of the plate and extends away from the end wall 28 of the passage slot 22 to an end wall 48. The floor 46 includes a convex arcuate surface 50 extending from the end wall 28 and a flat planar surface 52 that slopes from the arcuate surface 50 towards the top surface of the plate. A pair of opposed sidewalls 54 extend from the bottom surface of the plate to the floor 40. The sidewalls 54 are parallel with one another and extend from the slot lower sidewalls 30, whereby the width of the lower recess 26 between the sidewalls 44 is equal to the reduced width of the slot 22.

The metal contacts 14 are preferably formed from uniform thickness strip stock, which may be suitably plated beryllium copper. The illustrated contacts are 0.0017 inches thick. Each contact 14 is generally C-shaped and includes a flat body or central portion 60 and a pair of upper and lower contact arms 62, 64 extending from opposite sides of the central portion. The contact arms 62, 64 form resilient cantilever beams that extend away from the contact body. Contact surfaces 66, 67 are located on the upper and lower contact arms 62, 64 respectively for engaging contact pads on circuit members pressed against the plate 12. The two contact surfaces 66, 67 are spaced apart a distance greater than the thickness of the plate 12 when the contact is not stressed.

The contact central portion or body 60 includes a nominal width portion 68 adjacent the upper contact arm 62 and a reduced width portion 70 adjacent the lower contact arm 64 that form a contact shoulder 72. The shoulder 72 faces the lower contact arm 64 and forms an abutment surface that cooperates with a slot wall 38 to locate the contact axially in the slot. This limits movement of the contact 16 towards the bottom surface 20 of the plate 12 and enables the upper contact arm 62 to be compressed independently of the the lower contact arm 64.

The upper contact arm 62 includes an arcuate spring arm 74 that extends outwardly from the central contact portion to the contact surface 66 and an outer arm portion 76 that extends inwardly from the contact surface 66 to a contact end. The portion of the contact arm in the vicinity of the contact surface 66 is more sharply curved as shown in order for the contact surface 66 to form a pronounced contact nose. The width of the upper contact arm 64 tapers from the nominal width of the contact adjacent the contact body 60 to a reduced-width free end to reduce stress concentration when the upper contact arm 64 is stressed.

Figure 2:
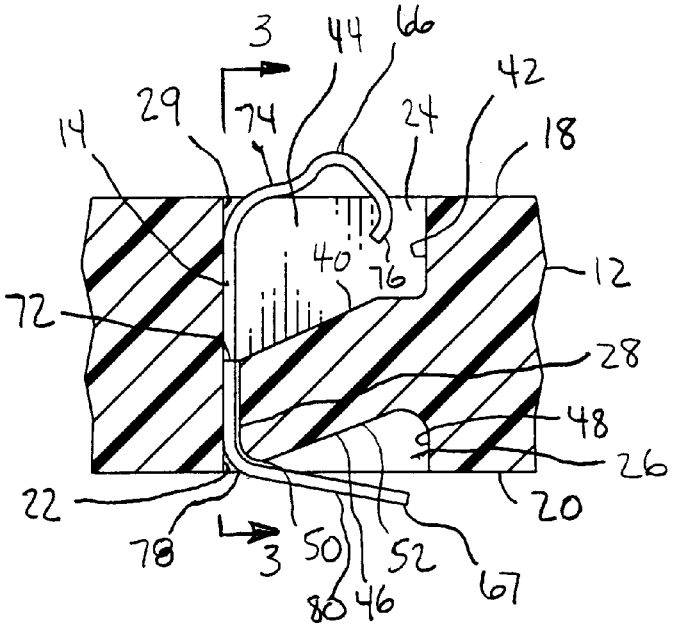
FIG. 2 is a sectional view taken along line 2—2 of FIG. 1.
Figure 3:
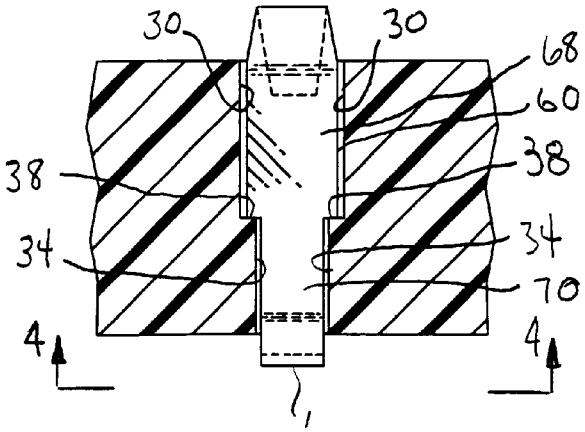
FIG. 3 is a sectional view taken along line 3—3 of FIG. 2.
Figure 4:
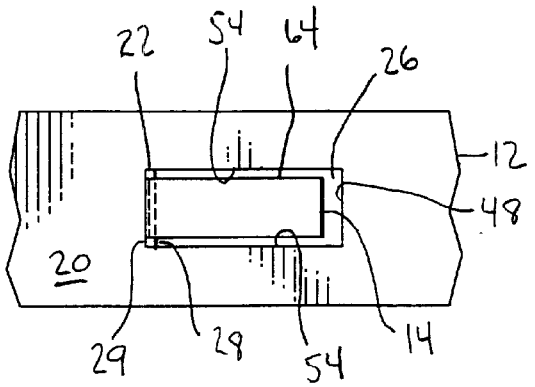
FIG. 4 is a view taken along line 4—4 of FIG. 3.

The lower contact arm 64 includes an arcuate, inner arm portion 78 adjacent the body portion 60 and an elongate, straight outer arm portion 80 that extends away from the contact body 60 to the contact surface 67 at the free end of the lower contact arm 64. The arcuate arm portion 78 holds the straight arm portion 80 nearly perpendicular to the contact body 60 as shown in FIG. 2. The lower contact arm 64 has a uniform width equal to the reduced width of the contact.

The contacts 14 are each held in a passage 16 with the nominal width portion 68 of the contact body 60 in the nominal width portion 32 of the passage slot 22 and the reduced width portion 70 of the contact body 60 in the reduced width portion 36 of the slot. See FIG. 3. The contact shoulders 72 of the contact 14 abut the transverse wall 38 of the passage 22. The shoulders 72 and wall 38 cooperate with each other to locate the contact body portion 60 in the passage 16 and limit movement of the contact in the passage 16 towards the lower surface of the plate 12.

The contact body portions 68, 70 and the slot portions 32, 36 have substantially rectangular lateral cross sections that cooperate to align the contact body in the slot. The contact body portions 68, 70 are closely spaced from the slot end walls 28, 29 and slot sidewalls 30, 34 to maintain vertical alignment of the contact in the passage. The upper contact arm 62 extends away from the slot end wall 29 towards the upper recess 24 and overlies the floor 40 of the recess 24. The contact nose 66 is spaced above the top surface of the plate 12. The free end of the contact arm 62 is located within the upper recess 24 to prevent the end from being caught between the plate 12 and a circuit member. The lower contact arm 64 extends away from the slot end wall 29 towards the lower recess 26. The arcuate portion 78 of the contact arm 64 substantially conforms with and closely faces or bears against the arcuate surface 50 of the floor 46. The leg 80 is spaced above the floor of the lower recess floor 46 with the contact surface 67 spaced below the bottom surface of the plate 12.

The arcuate floor surface 50 and the arcuate lower contact arm portion 78 cooperate with each other to prevent or limit movement or float of the contact 14 in the passage 16 towards the upper plate surface 18. Any float is insufficient to enable the free end of the upper contact arm 62 to escape from the upper recess 24, and retains the contact 14 in the passage 16.

As illustrated in FIG. 1, the passages 16 are arranged close to each other in a dense array on plate 12 to permit forming electrical connections between similar arrays of contact pads on circuit members located above and below the interposer assembly 10. Conventionally, assembly 10 is used for soldered connections between contact pads on a lower circuit member and pressure connections on the contact pads on an upper circuit member. The circuit members may include circuit boards or other types of circuit elements.

Figure 5:
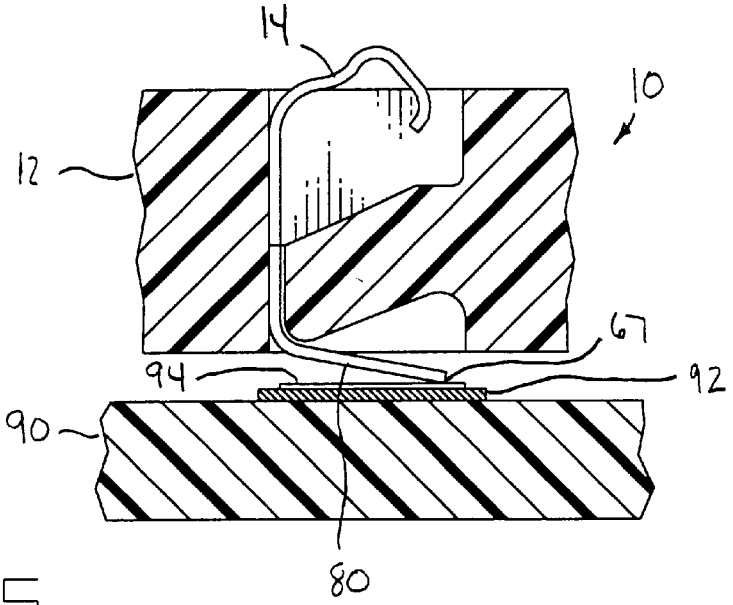
FIG. 5 is a view similar to FIG. 2 illustrating the position of the assembly of FIG. 1 against a lower circuit member.

FIG. 5 illustrates the interposer assembly 10 positioned adjacent a lower circuit member 90 prior to solder connections being formed between the contacts 14 and the circuit member. The contact pads 92 on the member are below each contact in the assembly and include a solder layer 94. The lower contact surfaces 67 lightly engage the pads and the contacts are not stressed.

Figure 6:
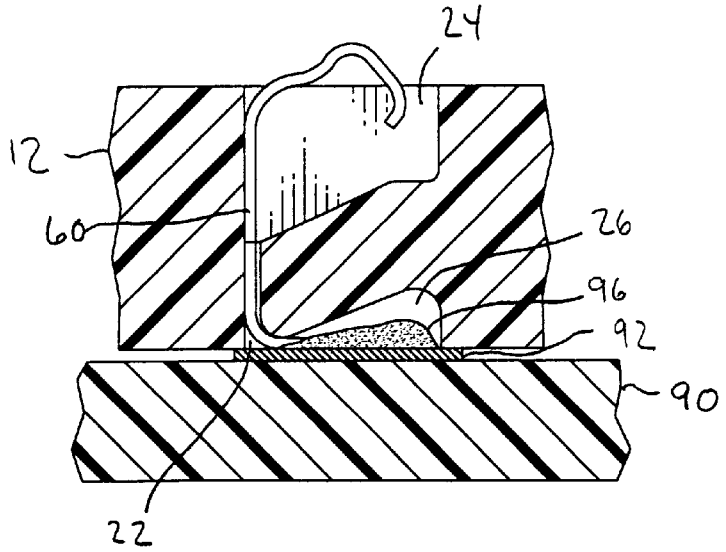
FIG. 6 is a view similar to FIG. 5 with the lower circuit member pressed against the lower circuit member and solder connections between the assembly and the lower circuit member.

FIG. 6 illustrates the assembly 10 when the lower circuit member 90 is pressed tightly against the plate 12. When the member 90 is brought into contact with the plate 12 the contact pads 92 bend the lower contact arm 64 of each contact 14 entirely within the lower recesses 26. The resiliency of the lower contact arm 64 enables the contact arm 64 to compress without applying a high closing force to the circuit member 90.

The arcuate portion 78 of the lower contact arm 64 bears against the facing arcuate surface 50 of the lower floor 46 a short distance from the slot 22. The torque generated by the closing force applied against the contact surface 67 of the lower contact arm urges rotation of the contact counterclockwise as seen in FIG. 6 and maintains the contact shoulders 70 against the slot wall 38. This effectively permits the contact arms 62, 64 to be compressed independently of each other and maintains the contact body 60 in the same location of the passage slot 22 before and after the circuit member 90 is pressed against the plate 12. The straight arm portion 80 comes parallel with the contact pad 92 and lies flat against the contact pad. The arm portion 80 has sufficient resiliency to space the contact surface 67 outwardly away from the bottom surface of the plate if the lower circuit member 90 must be removed prior to soldering.

After the circuit member 90 is pressed against the plate 12, each lower contact arm 64 is located entirely within a lower recess 26. The contact pads 92 preferably close the openings of the passage slots 22 and lower recesses 26 to the bottom surface of the plate. Solder connections 96 are then formed between the legs 80 and the contact pads 92, preferably by conventional reflow soldering. The volume of each lower recess 26 is sized to accommodate the solder connection entirely within the recess. The relatively large bearing area between the straight arm portions 80 and the contact pads ensure the solder connections form reliable electrical and mechanical connections between the lower contact arm portions 80 and the contact pads 102.

When the solder connections 96 cool and solidify, the contact shoulders 70 and the arcuate lower contact arm portions 78 grip the plate 12 between them. This securely holds the lower circuit member 90 against the plate 12 to form an interposer subassembly for subsequent handling and assembly with an upper circuit member.

The conductor bodies 60 snugly fit between the sidewalls of the passage slots 22 to prevent the flow of melted solder in the lower plate recesses 26 into the upper recesses 24. Such solder flow in any passage 16 could contact the upper contact arms 62 in the passage and adversely affect the resiliency of the spring arm 74. The clearance between the sidewalls and each contact body 60 is sufficiently small to resist flow of melted solder through the passage slot from the lower recess 26 into the upper recess 24. Alternatively, a contact body 60 can be press fit in a passage slot 22 to close fluid communication through the plate between the upper and lower recesses of the passage and obstruct the flow of solder through the passage slot.

Figure 7:
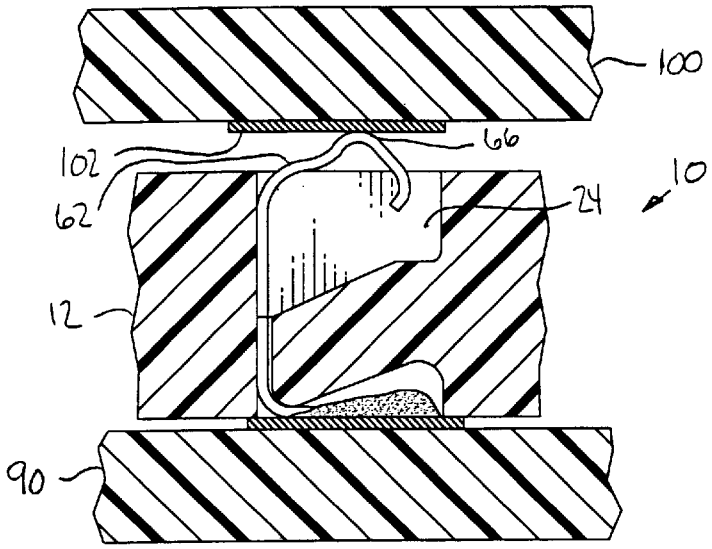
FIG. 7 is a view similar to FIG. 6 but with the assembly against an upper circuit member.

FIG. 7 illustrates the interposer assembly 10 and lower circuit member 90 positioned adjacent an upper circuit member 100 prior to pressure connections being formed between the contacts 14 and the circuit member 100. Contact pads 102 on the upper circuit member are above the contacts 14 in the assembly 10. The upper contact noses 66 lightly engage the pads and the contacts are not stressed. The contact noses 66 are spaced above the top surface 18 of the plate 12 a sufficient distance to compensate for spacing variations caused by manufacturing tolerances while assuring sufficient contact pressure can be generated between each contact nose 66 and contact pad 102 to form a reliable electrical pressure connection between them.

Figure 8:
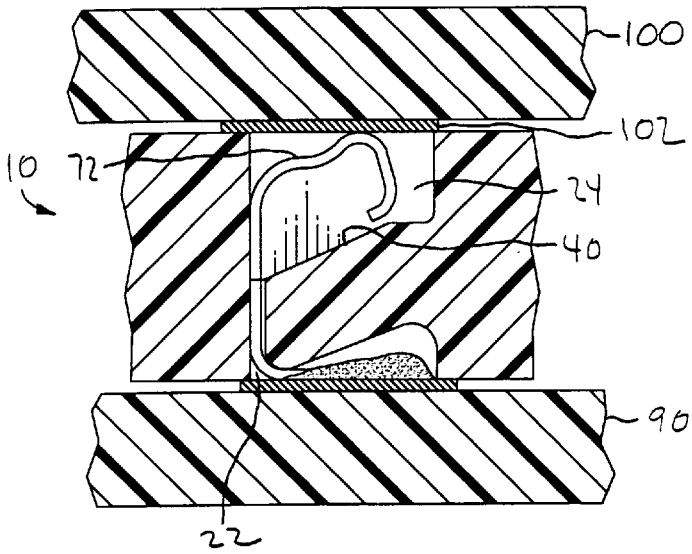
FIG. 8 is a view similar to FIG. 7 with the assembly sandwiched between the upper and lower circuit members.

FIG. 8 illustrates the assembly 10 when the upper circuit member 100 is pressed tightly against the plate 12. When the member 100 is brought into contact with the plate 12 the contact pads 102 bend the upper contact arm 62 of each contact 14 entirely within the upper recess 24. The spring arm 72 of the contact arm 62 acts as a cantilever spring and is elastically bent. The resiliency of the spring arm enables the contact arm 62 to compress with a low closing force. Bending of the spring arm 72 and foreshortening of the contact moves or wipes the contact nose 66 a distance along the contact pad 102 toward the passage slot 22 to make a clean, low resistance pressure electrical connections between the contact nose 66 and the pad 102.

Contact pressure is maintained by the elastic bending of the spring arm 72 without bottoming the end of the upper contact arm 62 on the upper recess floor 40. Such bottoming of contact ends could undesirably increase the closing force. Should the end of an upper contact arm ever bottom on the floor 40, the slope of the floor 40 guides the legs down the recess to minimize additional closing force. If it is necessary to replace or reseat the upper circuit member 100 the elasticity of the spring arms 72 return the contact noses 66 above the top surface of the plate for later reengagement with the contact pads 102.

The solder connections and the clean wiped pressure connections assure that the contacts 14 provide reliable, low resistance electrical paths between the upper and lower sets of contact pads.

Figure 9:
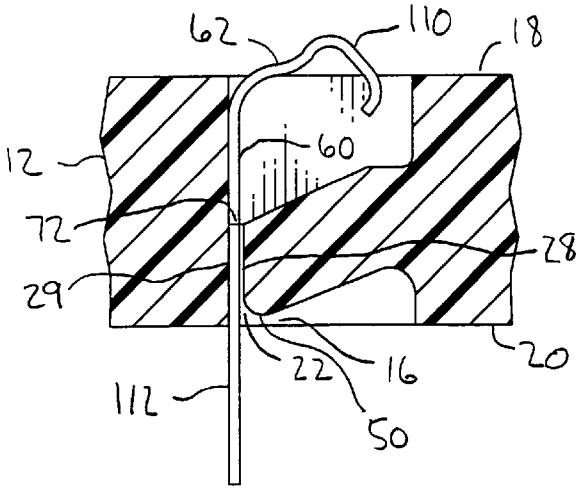
FIG. 9 is a view similar to FIG. 3 but illustrating a contact preform inserted in the plate of the assembly shown in FIG. 1.

The contacts 14 are formed from contact preforms 110, see FIG. 9, after the preforms 110 are inserted in the plate 12. A contact preform 110 is otherwise identical to a contact 14 except that the lower contact arm 64 is yet to be formed from a lower contact arm preform 112 planar with and extending away from the reduced width contact body portion 70. The remainder of the contact 14 is preformed to minimize variations in contact nose 66 spacing when the contacts are inserted in the passages 16.

Each contact preform 110 is inserted into a contact passage 16 from the top surface 18 of the plate 12. The contact arm preform 112 is inserted into the nominal width portion 32 and enters the reduced width portion 36 of the passage slot 22. The contact arm preform 112 is inserted yet further into the slot until the shoulders 72 of the contact body 60 abuts the transverse slot wall 38 and prevents further insertion of the contact.

At this point the contact preform 110 is located in the contact passage 16 as shown in FIG. 9 with the contact arm preform 112 extending away from the plate bottom surface 20. The upper spring arm 62 is in its unstressed position like in FIG. 2.

The contact arm preform 112 is then bent toward the lower recess to form the lower contact arm 64. The preform 112 bends around the arcuate surface 50 and plastically deforms to form the arcuate portion 78 of the lower contact arm 64. The radius of curvature of the arcuate portion 78 is substantially greater than the distance between the end walls 28, 29 to limit the plastic deformation of the lower contact arm and maintain resiliency of the contact arm.

Figure 10:
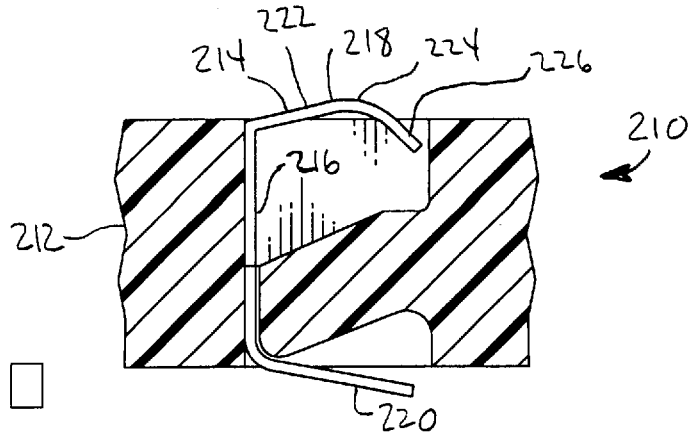
FIG. 10 is a view similar to FIG. 3 of a second interposer assembly per the invention.

FIG. 10 illustrates a second embodiment interposer assembly 210. Conventionally, assembly 210 is used for soldered connections between contact pads on both upper and lower circuit members. Interposer assembly 210 components include a flat plate 212 and a plurality of metal contacts 214 in the plate. The plate 212 is identical to the plate 12 and so will not be described further.

Each contact 214 has a central portion or body 216 similar to the contact body 60, an upper contact arm 218, and a lower contact arm 220 like the lower contact arm 64. The upper contact arm 218 includes an elongate, straight inner arm portion 222 that extends at almost a right angle away from the contact body to a convex contact surface or contact nose 224. A short extension 226 extends from the contact nose 222 to a free end located in the upper recess of the plate.

Figure 11:
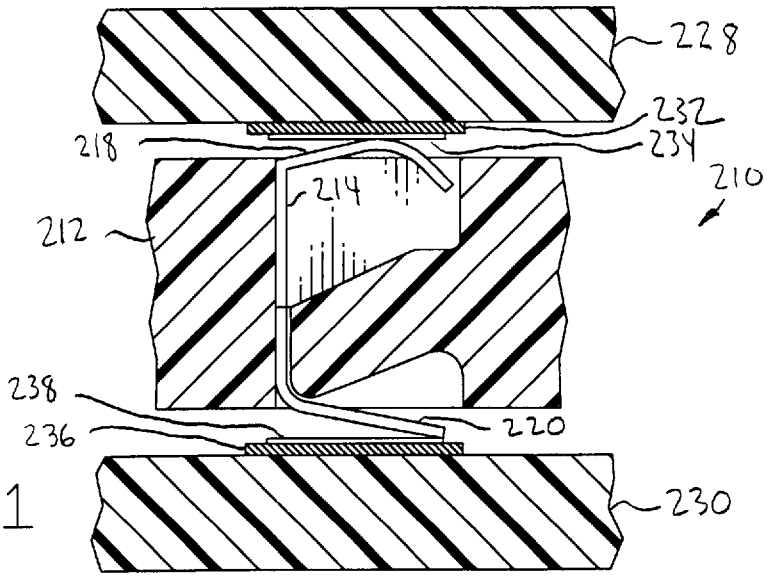
FIG. 11 is a view similar to FIG. 10 but with the assembly between upper and lower circuit members.

FIG. 11 illustrates the interposer assembly 210 positioned adjacent upper and lower circuit members 228, 230. The upper circuit member includes contact pads 232 above the contacts 214 and solder layers 234 on the pads. The lower circuit member includes contact pads 236 below the contacts 214 and solder layers 238 on the pads. The upper and lower contact pads lightly engage the contact surfaces of the contact arms and the contacts are not stressed. The distance between the contact surfaces on the lower and contact arms is greater than the thickness of the plate but less than the corresponding distance of a contact 14.

Figure 12:
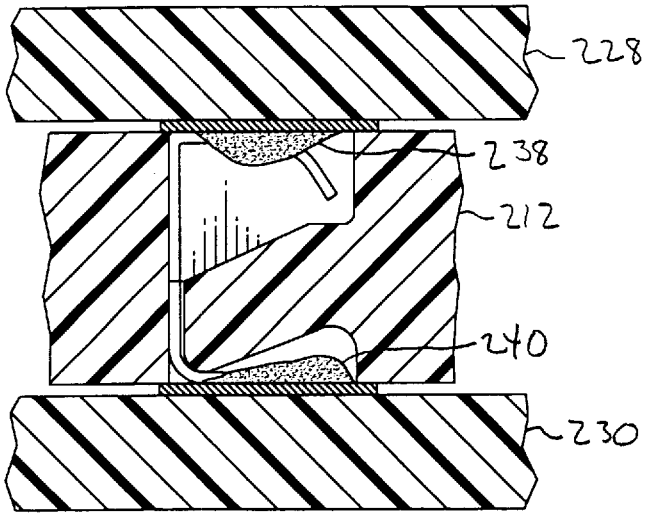
FIG. 12 is a view similar to FIG. 11 but with the assembly sandwiched between the upper and lower circuit members and solder connections between the contacts and contact pads of the circuit members.
Figure 10:
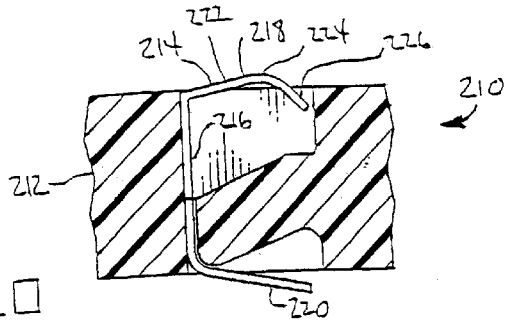
Figure 11:
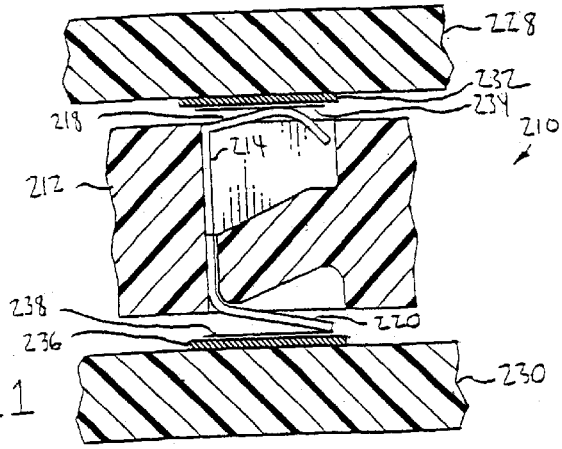
Figure 12:
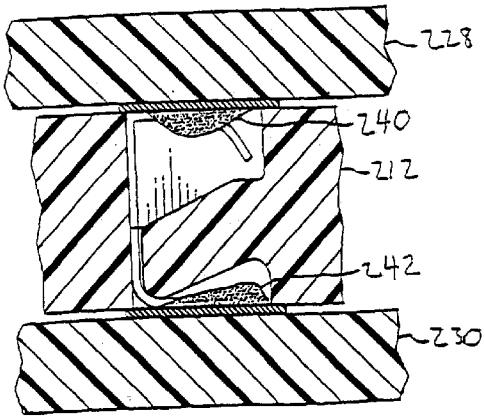

FIG. 12 illustrates the assembly 210 when the circuit members 228, 230 are pressed tightly against the plate 212. The contact pads bend the upper and lower contact arms 218, 220 into the upper and lower recesses of the plate. The resiliency of the contact arms enables each contact 214 to be compressed without a high closing force. The compressed contact arms lie flat against the contact pads. If it is necessary to replace or reseat either circuit member, the elasticity of the contact arms returns the contact surfaces away from the plate 212 for later reengagement with the contact pads.

After the circuit members 228, 230 are pressed against the plate 212, the upper and lower contact arms are located entirely within the upper and lower plate recesses. The contact pads 232, 236 preferably close the openings of the contact passages in the plate. Solder connections 240, 242 are then formed between the upper contact arms 218 and the upper contact pads 232 and between the lower contact arms 220 and the lower contact pads 236, preferably by reflow soldering. The volume of each upper recess is sized to accommodate a solder connection entirely within the recess.

Reflow soldering can be done to both circuit members simultaneously as described above. The same solder can form the solder layers on both the upper and lower circuit members. Alternatively, the upper and lower circuit members can be soldered to the contacts in separate operations. The solder forming the first melted solder layers will have a melting temperature higher than the solder forming the later melded solder layers. This assures that the first formed solder connections do not remelt during the subsequent soldering of the other circuit member.

The end of the floor of each upper recess of the interposer plate 12 or 212 adjacent the slot, the transverse wall in each slot and the bottom surface of the plate are located on the same side of a center plane located equidistant between the top and bottom surfaces of the plate. This increases the ability of the upper recess to receive an upper contact arm without the end of the arm grounding against the recess floor. The shape of the upper contact arm and the spacing of the upper contact surface above the plate can be varied to meet design requirements without changing the geometry of the plate 12. In other possible embodiments the shape of the upper recess can be designed to accommodate a specific upper contact arm configuration. In yet other embodiments the upper and lower recesses can be symmetrical with respect to each other about the center plane.

While we have illustrated and described preferred embodiments of our invention, it is understood that this is capable of modification, and we therefore do not wish to be limited to the precise details set forth, but desire to avail ourselves of such changes and alterations as fall within the purview of the following claims.

What we claim as our invention is:

1. An interposer component adapted to receive a plurality of like metal contacts to form an interposer assembly for establishing electrical connections between pairs of upper and lower contact pads arranged in a predetermined pattern, the interposer component comprising:

a plate formed from insulating material, the plate having a flat top surface, a flat bottom surface extending parallel to the top surface and a uniform thickness between the top and bottom surfaces;

a plurality of single contact passages in the plate, the passages spaced apart from one another, each contact passage comprising a slot extending through the thickness of the plate for receiving a contact in the passage, an upper recess extending away from the slot and open to the top surface of the plate and a lower recess extending away from the slot and open to the bottom surface of the plate;

each slot comprising opposed end walls defining opposite ends of the slot, upper and lower pairs of opposed side walls joining the end walls of the slot and a transverse wall facing the top surface of the plate between the upper and lower pairs of side walls, the upper pair of side walls extending from the top surface of the plate and defining an upper portion of the slot, the lower pair of side walls extending from the bottom surface of the plate and defining a lower portion of the slot, the upper portion of the slot defining the nominal width of the slot and the lower slot portion defining a reduced width portion of the slot;

the upper recess of each passage comprising a floor facing the top surface of the plate and a pair of opposed side walls, the floor spaced inwardly from the top surface of the plate and extending from the passage slot, the side walls extending from the top surface of the plate to the floor;

the lower recess of each passage comprising a floor facing the bottom surface of the plate and a pair of opposed side walls, the floor spaced inwardly from the bottom surface of the plate and extending from the passage slot, the side walls extending from the bottom surface of the plate to the floor; and the contact passages arranged in a pattern wherein the pattern of the upper recesses correspond to the pattern of the upper contact pads and the pattern of the lower recesses correspond to the pattern of the lower contact pads.

2. The interposer component as in claim 1 wherein the upper and lower recesses of each contact passage extend from one of the end walls of the passage slot, the floor of the upper recess overlying the floor of the lower recess whereby the contact pads of each pair of upper and lower contact pads vertically oppose one another.

3. The interposer component as in claim 2 wherein the floor of the lower recess of each contact passage slopes from the passage slot towards the top or bottom surface of the plate.

4. The interposer component as in claim 3 wherein the floor of the upper recess of each contact passage slopes from the passage slot towards the top or bottom surface of the plate.

5. The interposer component as in claim 4 wherein the floor of the upper recess of each contact passage slopes from the passage slot towards the top surface of the plate and the floor of the lower recess of each contact passage slopes from the passage slot towards the top surface of the plate.

6. The interposer component as in claim 5 wherein the floor of the upper recess of each contact passage comprises an end adjacent the slot of the contact passage; and each of the floor ends and the bottom surface of the plate are located on one side of a plane located equidistant between the top and bottom surfaces of the plate.

7. The interposer component as in claim 2 wherein the upper recess of each contact passage is spaced along the passage slot from the lower recess of the passage.

8. The interposer component as in claim 1 wherein the floor of the lower recess of each contact passage comprises an arcuate surface adjacent the slot of the contact passage.

9. The interposer component as in claim 8 wherein the end walls of each slot are spaced apart a distance defining the transverse width of the slot; and the arcuate surface of the floor of the lower recess of each contact passage has a radius of curvature greater than the transverse width of the slot of the contact passage.

10. The interposer component as in claim 1 wherein the upper portion of each slot extends to the lower portion of the slot whereby the upper and lower portions of the slot extend through the entire thickness of the plate.

11. The interposer component as in claim 10 wherein each of the upper and lower portions of each slot comprises a substantially rectangular transverse cross section.

12. The interposer component as in claim 11 wherein the side walls of the upper recess of each contact passage are parallel to one another and are spaced apart the nominal width of the passage slot and the side walls of the lower recess of each contact passage are parallel to one another and are spaced apart the reduced width of the passage slot.

13. The interposer component as in claim 1 wherein each slot is symmetrical to either side of a plane extending through the slot and perpendicular to the top and bottom surfaces of the plate.

14. The interposer component as in claim 1 wherein the transverse wall of each slot is to one side of a plane equidistant between the top and bottom surfaces of the plate.

15. The interposer component as in claim 14 wherein the transverse wall of each slot is on the same side of the plane as the bottom surface of the plate.

16. The interposer component as in claim 1 wherein the transverse wall of each contact passage is parallel with the top surface of the plate and adjacent the floor of the upper recess of the passage.

17. An interposer assembly for establishing electrical connections between spaced pairs of upper and lower contact pads, the interposer assembly comprising:

a plate formed from a single piece of insulating material, the plate having a flat top surface, a flat bottom surface extending parallel to the top surface and separated from the top surface by the thickness of the plate;

a plurality of single contact passages in the plate, the passages spaced apart from one another, each contact passage comprising a slot extending through the thickness of the plate, an upper recess, and a lower recess;

the slot of each contact passage comprising opposed end walls defining opposite ends of the slot, upper and lower pairs of opposed side walls joining the end walls of the slot and a transverse wall facing the top surface of the plate between the upper and lower pairs of side walls, the upper pair of side walls extending from the top surface of the plate and defining an upper portion of the slot, the lower pair of side walls extending from the bottom surface of the plate and defining a lower portion of the slot, the upper portion of the slot defining the nominal width of the slot and the lower slot portion defining a reduced width portion of the slot;

the upper recess of each contact passage open to the top surface of the plate and comprising a floor facing the top surface of the plate and a pair of opposed side walls, the floor spaced inwardly from the top surface of the plate and extending from an end wall of the passage slot, the side walls extending from the top surface of the plate to the floor;

the lower recess of each contact passage open to the bottom surface of the plate and comprising a floor facing the bottom surface of the plate and a pair of opposed side walls, the floor spaced inwardly from the bottom surface of the plate and extending from an end wall of the slot, the side walls extending from the bottom surface of the plate to the floor;

a metal contact in each contact passage, each contact comprising a body portion in the passage slot, upper and lower contact arms extending from the body portion, and a contact surface on each contact arm, the distance between the contact surfaces greater than the thickness of the plate when the contact arms are unstressed, the body portion comprising a nominal width portion in the nominal width portion of the slot, a reduced width portion in the reduced width portion of the slot and an abutment surface abutting the transverse wall of the slot to locate the contact in the contact passage, the upper contact arm extending into the upper recess and overlying the floor of the upper recess of the passage and the lower contact arm extending into the lower recess and overlying the floor of the lower recess of the passage;

the contact passages arranged in a pattern wherein the upper contact pads oppose the contact surfaces on the upper contact arms and the lower contact pads oppose the contact surfaces on the lower contact arms whereby the contact pads move the contact surfaces into the upper and lower recesses when the contact pads are pressed against the interposer assembly to electrically interconnect the contact pads.

18. The interposer assembly as in claim 17 wherein the upper contact arm of each contact comprises an arcuate contact nose.

19. The interposer assembly as in claim 18 wherein the upper contact arm of each contact is elastically stressed and the contact nose of the arm is wiped along the upper contact pad when the interposer assembly is pressed against the upper contact pads.

20. The interposer assembly of claim 18 wherein the upper contact arm of each contact comprises a straight portion extending between the contact body and the contact nose of the upper contact arm, the straight portion engaged against an upper contact pad when the interposer assembly is pressed against the upper contact pads.

21. The interposer assembly of claim 20 including a solder connection in each upper recess, each solder connection interconnecting the straight portion of the upper contact arm in the recess and the upper contact pad engaged therewith.

22. The interposer assembly of claim 17 wherein the lower contact arm of each contact comprises a straight portion extending between the contact body and the contact nose of the lower contact arm, the straight portion engaged against a lower contact pad when the interposer assembly is pressed against the lower contact pads.

23. The interposer assembly as in claim 22 including a solder connection in each lower recess, each solder connection interconnecting the straight portion of the lower contact arm in the recess and the lower contact pad engaged therewith.

24. The interposer assembly as in claim 17 wherein the reduced width portion of each contact is closely spaced from the adjacent walls of the slot containing the contact.

25. The interposer assembly as in claim 17 wherein the metal contacts are formed from uniform thickness metal.

26. The interposer assembly as in claim 17 wherein the lower contact arm of each contact is formed after the contact body portion is inserted into the plate.

27. The interposer assembly as in claim 26 wherein the upper contact arm of each contact is formed before the contact body portion is inserted in the plate.

28. The interposer assembly as in claim 27 wherein the floor of the lower recess of each contact passage comprises an arcuate surface adjacent the slot of the contact passage; and the lower contact arm of the contact in the contact passage comprises an arcuate portion extending from the contact body and facing the arcuate surface of the lower recess of the passage wherein the shape of the arcuate portion substantially conforms with the curvature of the arcuate surface.

29. The interposer assembly as in claim 28 wherein the arcuate portion of the lower contact arm of the contact in each contact passage bears against the arcuate surface of the lower recess of the passage to limit movement of the contact towards the top side of the plate.

* * * * *

UNITED STATES PATENT AND TRADEMARK OFFICE

CERTIFICATE OF CORRECTION

PATENT NO. : 6,488,513 B1 
DATED : December 3, 2002
INVENTOR(S) : Douglas A. Neidich and Donald W. Milbrand, Jr.

It is certified that error appears in the above-identified patent and that said Letters Patent is hereby corrected as shown below:

Drawings,
In figure 12 replace reference numeral “238” with -- 240 --; replace reference numeral “240” with -- 242 --.

Signed and Sealed this

Second Day of March, 2004

JON W. DUDAS
*Acting Director of the United States Patent and Trademark Office*